US007134617B2

(12) United States Patent
Ikushima

(10) Patent No.: US 7,134,617 B2
(45) Date of Patent: Nov. 14, 2006

(54) DROPLETS FORMING METHOD AND DEVICE FOR DISCHARGING CONSTANT-VOLUME DROPLETS

(75) Inventor: Kazumasa Ikushima, Mitaka (JP)

(73) Assignee: Musashi Engineering, Inc., Tokyo (JP)

( * ) Notice: Subject to any disclaimer, the term of this patent is extended or adjusted under 35 U.S.C. 154(b) by 121 days.

(21) Appl. No.: 10/472,194

(22) PCT Filed: Mar. 25, 2002

(86) PCT No.: PCT/JP02/02843

§ 371 (c)(1),
(2), (4) Date: Mar. 8, 2004

(87) PCT Pub. No.: WO02/076623

PCT Pub. Date: Oct. 3, 2002

(65) Prior Publication Data

US 2004/0134996 A1 Jul. 15, 2004

(30) Foreign Application Priority Data

Mar. 27, 2001 (JP) ..... 2001-091018

(51) Int. Cl.

| | |
|---|---|
| ***B05B 17/00*** | (2006.01) |
| ***B05B 1/30*** | (2006.01) |
| ***B05B 15/08*** | (2006.01) |
| ***F02D 1/06*** | (2006.01) |

(52) U.S. Cl. ..... 239/584; 239/1; 239/5; 239/569; 239/587.1; 239/347

(58) Field of Classification Search ..... 239/584, 239/1, 5, 11, 569, 587.1, 337, 347, 349; 96/30, 96/125, 219; 55/459.1
See application file for complete search history.

(56) References Cited

U.S. PATENT DOCUMENTS 3,904,392 A * 9/1975 Vaningen et al. ..... 95/30

(Continued)

FOREIGN PATENT DOCUMENTS

JP 73175 5/1988

(Continued)

*Primary Examiner*—Davis Hwu
(74) *Attorney, Agent, or Firm*—Westerman, Hattori, Daniels & Adrian, LLP.

(57) ABSTRACT

The invention intends to prevent the occurrence of a phenomenon that air is sucked through an ejection port formed at a nozzle end when a plunger rod is retracted to move away from a valve seat. In a method or apparatus for ejecting liquid droplets in which a liquid under regulated pressure, the liquid being stored in a container as required, is ejected while it is caused to fly in the form of liquid droplets from a valve ejection port, bubbles are prevented from being mixed into the liquid through the ejection port by controlling a supply amount of the liquid in a manner being able to follow a pressure difference between the ejection port and a flow passage in a valve body. The liquid is continuously ejected at a high-speed tact. The ejection port is opened with a plunger rod retracted by air pressure, and the liquid droplet is ejected through the ejection port with the plunger rod advanced by a resilient force of a spring. Bubbles are prevented from mixed in the liquid through the ejection port upon retraction of the plunger rod by controlling a retraction speed of the plunger rod in accordance with an air flow rate.

11 Claims, 2 Drawing Sheets

U.S. PATENT DOCUMENTS 4,205,966 A * 6/1980 Horikawa ..... 95/30
5,022,899 A * 6/1991 Hohlfeld et al. ..... 96/175
5,182,580 A * 1/1993 Ikeda et al. ..... 347/19
5,853,456 A * 12/1998 Bryan et al. ..... 95/30
6,060,125 A 5/2000 Fujii
6,537,505 B1 * 3/2003 LaBudde et al. ..... 422/103

FOREIGN PATENT DOCUMENTS

JP 64-70160 3/1989
JP 11-156266 6/1999
WO WO89/03255 4/1989

* cited by examiner

DROPLETS FORMING METHOD AND DEVICE FOR DISCHARGING CONSTANT-VOLUME DROPLETS

BACKGROUND OF THE INVENTION

1. Field of the Invention

The present invention relates to a method of ejecting liquid droplets and an apparatus for ejecting liquid droplets in fixed amount, in which a liquid under regulated pressure is ejected while it is caused to fly in the form of liquid droplets from a valve ejection port. More particularly, the present invention relates to a method of ejecting liquid droplets and an apparatus for ejecting liquid droplets in fixed amount, which are suitably used to handle various kinds of liquids including a solution having a uniform concentration, a liquid containing fillers, liquids having any viscosity from a low to high level, and a highly-viscose paste-like liquid as a combination of those liquids.

2. Description of the Related Art

In a conventional apparatus for ejecting liquid droplets, a liquid material supplied to a valve body is pushed into a flow passage within the valve body under constant pressure regulated by a pressure regulating device. However, such a conventional apparatus has a problem as follows. When a valve is opened, i.e., when a plunger rod is retracted to move away from a valve seat, air is sucked through an ejection port formed at a nozzle end, and bubbles are mixed in the liquid inside the valve body. As a result, the liquid cannot be ejected in desired amount.

The inventor has found that the above-mentioned phenomenon occurs for the reason given below. When the plunger rod is shifted from a valve-closed state in which the rod is seated against the valve seat provided in the valve body, to a valve-open state in which the rod is retracted to move away from the valve seat, a volume that is occupied by the plunger rod in the flow passage within the valve body is reduced and the pressure in the flow passage is lowered correspondingly. This causes a pressure difference between the nozzle end and the flow passage, and the pressure difference increases as the shift speed of the plunger rod is increased. Therefore, the supply amount of the liquid material pushed into the flow passage within the valve body under a constant pressing force cannot follow the pressure difference, thus resulting in a phenomenon that the atmosphere is sucked into the flow passage through the ejection port formed at the valve end for evenness of pressure. Particularly when the liquid is continuously ejected at a high-speed tact (short cycle), such a phenomenon appears noticeably because the plunger rod must be contracted at high speed.

SUMMARY OF THE INVENTION

With the above-mentioned finding in mind, it is an object of the present invention to provide a method of ejecting liquid droplets and an apparatus for ejecting liquid droplets in fixed amount, which can prevent the occurrence of a phenomenon that air is sucked through an ejection port formed at a nozzle end when a valve is opened, i.e., when a plunger rod is retracted to move away from a valve seat, and which can prevent bubbles from being mixed in the liquid ejected after the occurrence of such a phenomenon.

The present invention resides in a method of ejecting liquid droplets in which a liquid under regulated pressure, the liquid being stored in a container as required, is ejected while it is caused to fly in the form of liquid droplets from a valve ejection port, wherein bubbles are prevented from being mixed into the liquid through the ejection port by controlling a supply amount of the liquid in a manner being able to follow a pressure difference between the ejection port and a flow passage in a valve body.

The liquid is continuously ejected at a high-speed tact. In this case, the present invention resides in a method of continuously ejecting liquid droplets at a high tact in which a liquid under regulated pressure, the liquid being stored in a container as required, is ejected while it is caused to fly in the form of liquid droplets from a valve ejection port, wherein bubbles are prevented from being mixed into the liquid through the ejection port by controlling a supply amount of the liquid in a manner being able to follow a pressure difference between the ejection port and a flow passage in a valve body.

The ejection port is opened with a plunger rod retracted by air pressure, and the liquid droplet is ejected through the ejection port with the plunger rod advanced by a resilient force of a spring. In this case, the present invention resides in a method of ejecting liquid droplets, preferably continuously ejecting liquid droplets at a high tact, in which a liquid under regulated pressure, the liquid being stored in a container as required, is ejected while it is caused to fly in the form of liquid droplets from a valve ejection port, wherein bubbles are prevented from being mixed into the liquid through the ejection port by controlling a supply amount of the liquid in a manner being able to follow a pressure difference between the ejection port and a flow passage in a valve body, and wherein the ejection port is opened with a plunger rod retracted by air pressure, and the liquid droplet is ejected through the ejection port with the plunger rod advanced by a resilient force of a spring.

Bubbles are prevented from mixed in the liquid through the ejection port upon retraction of the plunger rod by controlling a retraction speed of the plunger rod in accordance with an air flow rate. In this case, the present invention resides in a method of ejecting liquid droplets, preferably continuously ejecting liquid droplets at a high tact, in which a liquid under regulated pressure, the liquid being stored in a container as required, is ejected while it is caused to fly in the form of liquid droplets from a valve ejection port, wherein bubbles are prevented from being mixed into the liquid through the ejection port upon retraction of the plunger rod by controlling a retraction speed of the plunger rod in accordance with an air flow rate such that a supply amount of the liquid is able to follow a pressure difference between the ejection port and a flow passage in a valve body, and wherein the ejection port is opened with a plunger rod retracted by air pressure, and the liquid droplet is ejected through the ejection port with the plunger rod advanced by a resilient force of a spring.

Also, the present invention resides in an apparatus for ejecting liquid droplets in fixed amount, wherein the apparatus comprises a valve body having an ejection port; a plunger rod for ejecting a liquid droplet upon retraction thereof; liquid supply means for supplying a liquid to the valve body, the liquid supply means preferably comprising a liquid reservoir container for supplying the liquid to the valve body and liquid pressurizing means for pressurizing the liquid in the liquid reservoir container to a desired pressure; valve-operating pressure control means for controlling valve-operating air to a desired pressure; and a selector valve being able to shift between a first position at which the valve-operating pressure control means is communicated with the valve body and a second position at which the valve body is communicated with the atmosphere, the selector valve being preferably a solenoid selector valve, the ejection port of the valve body being opened when the selector valve is in the first position and the plunger rod is retracted by the valve-operating air and being closed when the selector valve is in the second position and the plunger rod is advanced by plunger-rod driving means, e.g., a spring or air pressure, the valve-operating pressure control means and the valve body being communicated with each other via a flow control valve.

A wall surface of the valve body, with which the plunger rod is abutted, and a fore end surface of the plunger rod are formed as flat surfaces, and the ejection port is closed upon both the surfaces coming into a surface contact state. Preferably, a projection having a maximum outer diameter equal to an inner diameter of the ejection port is provided on a fore end surface of the plunger rod. In this case, the present invention resides in an apparatus for ejecting liquid droplets in fixed amount, wherein the apparatus comprises a valve body having an ejection port; a plunger rod for ejecting a liquid droplet upon retraction thereof; liquid supply means for supplying a liquid to the valve body, the liquid supply means preferably comprising a liquid reservoir container for supplying the liquid to the valve body and liquid pressurizing means for pressurizing the liquid in the liquid reservoir container to a desired pressure; valve-operating pressure control means for controlling valve-operating air to a desired pressure; and a selector valve being able to shift between a first position at which the valve-operating pressure control means is communicated with the valve body and a second position at which the valve body is communicated with the atmosphere, the selector valve being preferably a solenoid selector valve, the ejection port of the valve body being opened when the selector valve is in the first position and the plunger rod is retracted by the valve-operating air and being closed when the selector valve is in the second position and the plunger rod is advanced by plunger-rod driving means, e.g., a spring or air pressure, the valve-operating pressure control means and the valve body being communicated with each other via a flow control valve, wherein a wall surface of the valve body, with which the plunger rod is abutted, and a fore end surface of the plunger rod are formed as flat surfaces, and the ejection port is closed upon both the surfaces coming into a surface contact state, and wherein preferably a projection having a maximum outer diameter equal to an inner diameter of the ejection port is provided on a fore end surface of the plunger rod.

MODE FOR CARRYING OUT THE INVENTION

Figure 1:
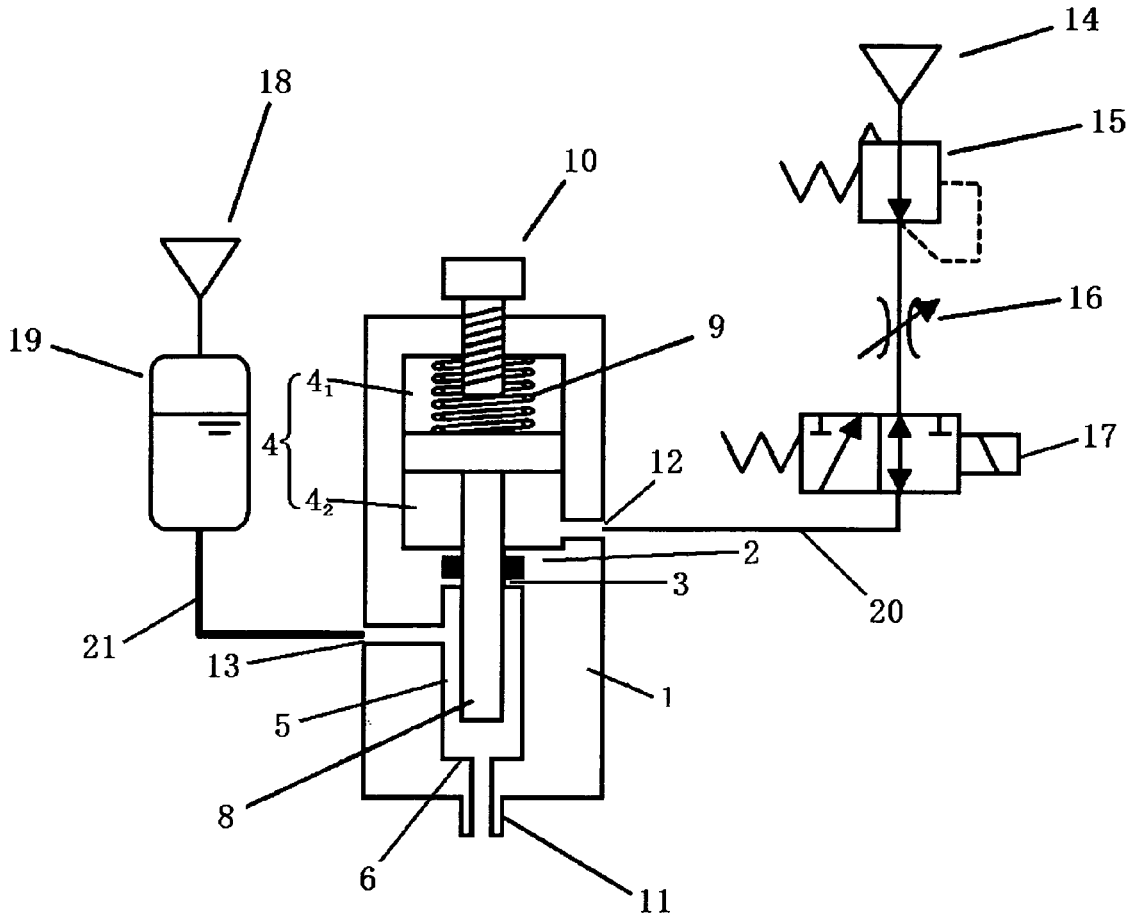
FIG. 1 is a schematic view of an apparatus for ejecting liquid droplets in fixed amount, according to the present invention, in a valve-open state (first position).

With a preferred mode of a method of ejecting liquid droplets, according to the present invention, an ejection port is opened with a plunger rod retracted by air pressure, and a liquid droplet is ejected through the ejection port with the plunger rod advanced by a resilient force of a spring, and bubbles are prevented from being mixed into the liquid through the ejection port upon retraction of the plunger rod by controlling a retraction speed of the plunger rod in accordance with an air flow rate.

With a preferred mode of an apparatus for ejecting liquid droplets in fixed amount, according to the present invention, the apparatus comprises a valve body having an ejection port; a plunger rod for ejecting a liquid droplet upon retraction thereof; a liquid reservoir container for supplying a liquid to the valve body; valve-operating pressure control means for controlling valve-operating air to a desired pressure; and a selector valve being able to shift between a first position at which the valve-operating pressure control means is communicated with the valve body and a second position at which the valve body is communicated with the atmosphere, the selector valve being preferably a solenoid selector valve, the ejection port of the valve body being opened when the selector valve is in the first position and the plunger rod is retracted by the valve-operating air and being closed when the selector valve is in the second position and the plunger rod is advanced by a resilient force of a spring or air pressure, the valve-operating pressure control means and the valve body being communicated with each other via a flow control valve.

The valve body is operated based on the principle that when closing the valve, the plunger rod is seated against a valve seat by utilizing, as a driving source, a resilient force of a spring or air pressure, and when opening the valve, the plunger rod is retracted to move away from the valve seat by applying an air pressure that is higher than the resilient force of the spring or the holding air pressure. The direction in which and the speed at which the plunger rod is moved are determined depending on the difference between the resilient force of the spring or the holding air pressure and the applied air pressure (i.e., the spring/air or air/air pressure difference). When closing the valve from the open state, therefore, the applied air pressure is reduced to a level lower than the resilient force of the spring (or the holding air pressure), causing the plunger rod to be seated against the valve seat.

The case of utilizing, as driving means, the spring/air pressure difference will be described below.

In order to fly a liquid droplet from the ejection port, it is required that a large acceleration is given to the plunger rod with an abrupt reduction of the applied air pressure, and the movement of the plunger rod is stopped as soon as the plunger rod is seated against the valve seat. Such an operation of the plunger rod provides an inertial force to the liquid and causes the liquid to fly in the form of a droplet from the ejection port. Accordingly, the spring is preferably selected to have the spring constant capable of giving the plunger rod a sufficient acceleration to fly the liquid droplet in desired amount. The seating of the plunger rod against the valve seat and the stoppage of the rod movement are properly performed by forming, as flat surfaces, a wall surface of the valve body, with which the plunger rod is abutted, and a fore end surface of the plunger rod, bringing both the surfaces into a surface contact state, and preferably providing, on a fore end surface of the plunger rod, a projection having a maximum outer diameter equal to an inner diameter of the ejection port. Note that the projection involves one having a maximum outer diameter substantially equal to the inner diameter of the ejection port so long as an equivalent action to that obtainable with the projection having a maximum outer diameter equal to the inner diameter of the ejection port is obtained.

When the plunger rod is moved from the closed position to the open position, a pressure drop of in a flow passage within the valve body is increased and the atmosphere is more easily sucked through the ejection port as the moving speed of the plunger rod increases. In view of the above, the speed of retraction of the plunger rod is controlled so that the atmosphere is not sucked through the ejection port. Stated otherwise, the air pressure much greater than the resilient force of the spring must not be abruptly applied to the plunger rod.

Herein, as well known, a spring stores a greater force as a displacement from its natural length increases. Comparing a spring with a natural length and a spring contracted or extended from the natural length, the latter spring requires work for displacing it through a certain distance. This means that the longer the distance through which the plunger rod is moved, the greater force is required to move the plunger rod through the corresponding distance.

The applied air pressure is required to be greater than the resilient force of the spring, and it must be increased as the stroke of the plunger rod increases. On the other hand, once the resilient force of the spring and the applied air pressure are decided, the moving speed of the plunger rod is uniquely decided because the capability of supplying the air pressure to the valve body is constant.

In particular, the moving speed of the plunger rod is maximized at the moment when the plunger rod is moved away from the valve seat, and it becomes impossible to set the moving speed of the plunger rod to a value at which bubbles are not mixed into the liquid through the ejection port. It is therefore required to control the moving speed of the plunger rod by controlling a flow rate of air that is adjusted to have a constant air pressure.

More specifically, a flow control valve is disposed between a selector valve communicating with the valve body and valve-operating pressure control means for controlling, to a desired pressure, air that serves to operate the plunger rod.

The selector valve can be shifted between a first position in which the flow control valve communicating with the valve-operating pressure control means is communicated with the valve body to move the plunger rod into the open position, and a second position in which the valve body is communicated with the atmosphere to move the plunger rod into the closed position.

When the plunger rod in the closed position is retracted to move into the open position, the selector valve is shifted from the second position to the first position. At the first position, air working on the plunger rod to operate it and controlled to the desired pressure and is supplied to the valve body while the flow rate of the working air is controlled by the flow control valve. Hence, the plunger rod starts to retract at a desired speed.

Since the plunger rod can be thus moved at the desired speed, it is possible to prevent bubbles from being sucked through the fore end of the ejection port even when the amount of movement of the plunger rod is increased.

Also, when the plunger rod in the open position is advanced to move into the closed position, the selector valve is shifted from the first position to the second position. At the second position, since the valve body is communicated with the atmosphere, the air for operating the plunger rod, which has so far worked on the plunger rod to retract the same, is released to the atmosphere at a stroke. Therefore, the pressure of the air for operating the plunger rod becomes equal to the atmospheric pressure in a moment. Accordingly, the spring that has been contracted and has stored resilient energy is momentarily extended to advance the plunger rod. The plunger rod is brought into abutment with the valve body and its movement is quickly stopped. As a result, only the liquid is ejected in the form of a droplet through the ejection port.

The movement of the plunger rod can be stopped at the same as the plunger rod is seated against the valve seat, with such an arrangement that the wall surface of the valve body, with which the plunger rod is abutted, and the fore end surface of the plunger rod are formed as flat surfaces, the ejection port is closed upon both the surfaces coming into a surface contact state, and preferably a projection having a maximum outer diameter equal to the inner diameter of the ejection port is provided on the fore end surface of the plunger rod. That operation of the plunger rod provides an inertial force to the liquid and causes the liquid to fly in the form of a droplet from the ejection port.

EMBODIMENT

The present invention will be described below in more detail in conjunction with an embodiment, but it should be noted that the present invention is limited in no way by the following embodiment.

The apparatus for ejecting liquid droplets in fixed amount, according to the present invention, comprises a valve unit for ejection liquid droplets, a liquid supply unit for supplying a liquid to the valve unit, and an air supply unit for supplying working air to the valve unit.

Figure 2:
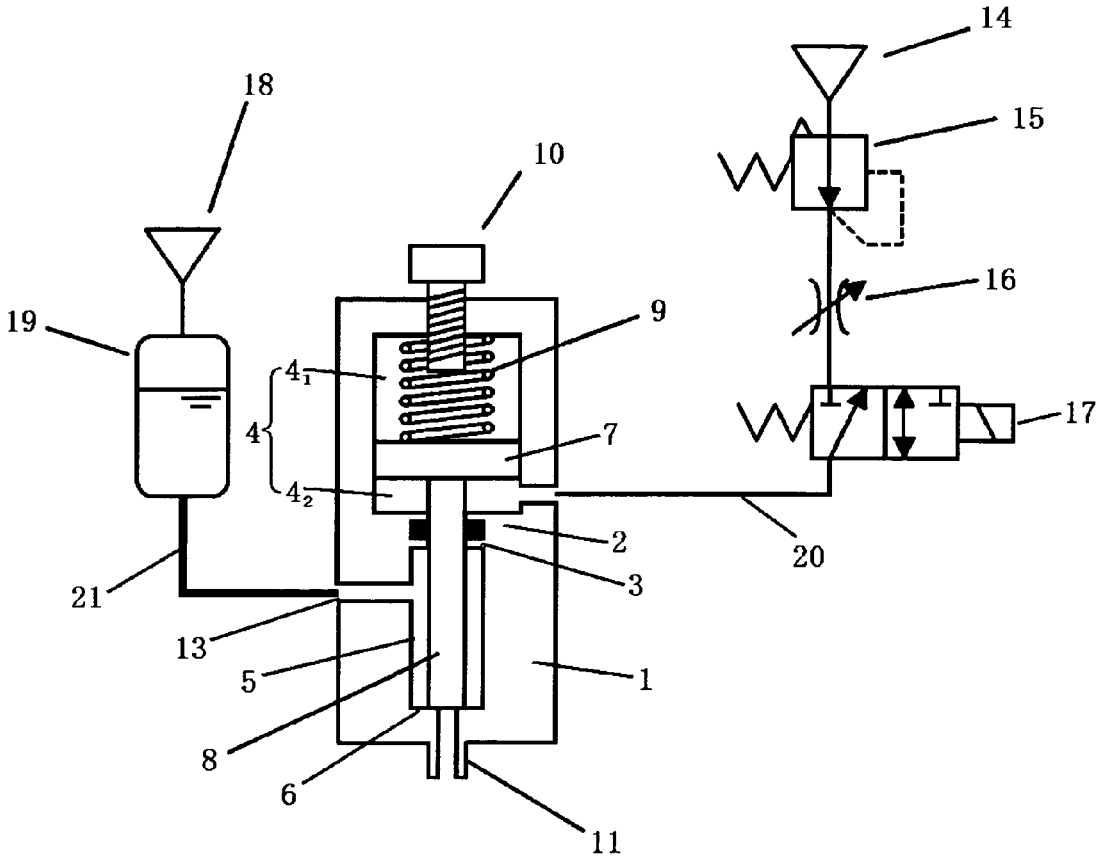
FIG. 2 is a schematic view of an apparatus for ejecting liquid droplets in fixed amount, according to the present invention, in a valve-closed state (second position).

Detailed constructions of those units in one embodiment of the present invention will be described below with reference to the drawings in which FIG. 1 is a schematic view showing the various units in a valve-open state (first position) and FIG. 2 is a schematic view showing the various units in a valve-closed state (second position).

A valve body 1 constituting the valve unit has a nozzle 11 formed in its bottom portion for ejecting liquid droplets. An inner space of the valve body is divided into two vertically spaced chambers, i.e., a driving chamber 4 and an ejection chamber 5, by a partition 2 having a penetration hole 3 through which a plunger rod 8 is inserted. A piston 7 for vertically moving the plunger rod 8 is slidably fitted in the upper driving chamber 4. A part of the driving chamber 4 located above the piston 7 forms a spring chamber $\mathbf{4}_1$, and a spring 9 is disposed between an upper surface of the piston 7 and an upper inner wall surface of the spring chamber $\mathbf{4}_1$. Also, a part of the driving chamber 4 located below the piston 7 forms an air chamber $\mathbf{4}_2$, which is connected to a high-pressure pneumatic source 14 via a pipe 20 and an air supply unit, the pipe 20 being connected to a joint port 12 formed in a side wall of the valve body 1. With that arrangement, high-pressure air for retracting the plunger rod 8 is supplied.

Additionally, reference numeral 10 in the drawing denotes a stroke adjusting screw 10 that is screwed through an upper wall of the driving chamber 4 and is vertically movable in its set position to adjust an upper limit of movement of the plunger rod 8, thereby regulating the amount of ejection liquid.

The plunger rod 8 capable of advancing and retracting with the piston 7 is inserted into the ejection chamber 5, and a liquid ejection port 6 communicating with the nozzle 11, which is provided in the bottom portion of the valve body 1, is formed in a bottom wall of the ejection chamber 5. Further, the ejection chamber 5 is connected to a liquid reservoir 19 via a pipe 21 that is connected to a joint opening 13 formed in the side wall of the valve body 1. Thus, the liquid for forming liquid droplets is supplied to the ejection chamber 5.

The plunger rod 8 has a fore end surface that is brought into abutment with the bottom wall of the ejection chamber 5 and closes the liquid ejection port 6 when the plunger rod 8 is advanced. Accordingly, the plunger rod 8 has a length set such that an air chamber is formed below the piston 7 when the plunger rod 8 is brought into contact with the bottom wall of the ejection chamber 5 for closing the valve.

The fore end surface of the plunger rod 8 and the bottom wall surface of the ejection chamber 5 are formed as flat surfaces, and when the valve is closed, both the surfaces come into a surface contact state, whereby the liquid ejection port 6 is closed and the ejection of liquid droplets is stopped. With such an arrangement, the liquid droplet to be ejected and the liquid in the ejection chamber 5 are surely separated from each other when the valve is closed.

Further, a projection having a maximum outer diameter equal to the inner diameter of the liquid ejection port 6 may be provided on the fore end surface of the plunger rod 8 such that the projection is fitted to the liquid ejection port 6 when the valve is closed. This arrangement enables the liquid to be shut off in a more satisfactory manner upon closing of the valve.

The liquid supply unit comprises a liquid pressurizing means 18 and a liquid reservoir container 19 that is formed integrally with or separately from the valve body 1. In the latter case, the liquid reservoir container 19 is communicated with the ejection chamber 5 of the valve body 1 via the pipe 21 connected to the valve body 1 using a joint. The liquid in the liquid reservoir container 19 is regulated to be kept under a constant pressure at all times by air pressure that is adjusted to a desired pressure by the liquid pressurizing means 18.

In the illustrated embodiment, the liquid is supplied to the valve unit while the liquid pressure is regulated by holding the pressure in the liquid reservoir container 19 constant with the liquid pressurizing means 18. As an alternative, however, a pressure regulating means may be disposed in a line connecting a liquid supply source (not shown) and the valve unit so that the liquid is supplied to the valve unit while the liquid pressure is regulated by the pressure regulating means.

The air supply unit comprises a valve-operating pressure control means 15, a flow control valve 16, and a selector valve 17, which are connected in series. More concretely, the flow control valve 16 is disposed between a solenoid selector valve 17 communicating with the valve body 1 and the valve-operating pressure control means 15 for controlling, to a desired pressure, air that serves to operate the plunger rod 8.

The selector valve 17 can be shifted between a first position in which the flow control valve 16 communicating with the valve-operating pressure control means 15 is communicated with the valve body 1 to move the plunger rod 8 into the open position, and a second position in which the air chamber $\mathbf{4}_2$ of the driving chamber 4 is communicated with the atmosphere to move the plunger rod 8 into the closed position. As a result, the direction of movement of the plunger rod 8 is switched over.

With the construction described above, when the plunger rod 8 in the closed position is retracted to move into the open position, the selector valve 17 is shifted from the second position to the first position. At the first position, air working on the plunger rod to operate it and controlled to the desired pressure is supplied to the valve body 1 while the flow rate of the working air is controlled by the flow control valve 16. Hence, the plunger rod 8 starts to retract at a desired speed.

Since the plunger rod 8 can be thus moved at the desired speed, it is possible to prevent bubbles from being sucked through the fore end of the ejection port 6 even when the amount of movement of the plunger rod 8 is increased.

Also, when the plunger rod 8 in the open position is advanced to move into the closed position, the selector valve 17 is shifted from the first position to the second position. At the second position, since the valve body 1 is communicated with the atmosphere, the air for operating the plunger rod 8, which has so far worked on the plunger rod 8 to retract the same, is released to the atmosphere at a stroke. Therefore, the pressure of the air for operating the plunger rod 8 becomes equal to the atmospheric pressure in a moment. Accordingly, the spring 9 that has been contracted and has stored resilient energy is momentarily extended to advance the plunger rod 8. The plunger rod 8 is brought into abutment with the valve body and its movement is quickly stopped. As a result, only the liquid is ejected in the form of a droplet through the ejection port 6.

In the present invention, the liquid is continuously ejected at a high-speed tact. The term "high-speed tact" means that the liquid ejection is repeated intermittently at a short cycle. How many times the liquid is ejected per second is set as required.

According to the present invention having the construction described above, air is prevented from sucked through the ejection port formed at the nozzle end when the plunger rod is retracted for ejecting a liquid, and the liquid can be ejected in fixed amount and formed into a droplet mixed with no bubbles. Particularly, even when the amount of movement of the plunger rod is increased, a required pressure can be supplied in a desired time. Hence, suction of air into the valve body can be effectively prevented without causing an unnecessary negative pressure in the valve body.

Also, with such an arrangement that the wall surface of the valve body, with which the plunger rod is abutted, and the fore end surface of the plunger rod are formed as flat surfaces, and the ejection port is closed upon both the surfaces coming into a surface contact state, the liquid droplet to be ejected and the liquid in the ejection chamber are surely separated from each other when the valve is closed. Further, by providing a projection having a maximum outer diameter equal to the inner diameter of the ejection port on the fore end surface of the plunger rod such that the projection is fitted to the ejection port when the valve is closed, the liquid can be shut off in a more satisfactory manner upon closing of the valve.

What is claimed is:

1. A method of ejecting liquid droplets comprising:

ejecting a liquid under regulated pressure in the form of liquid droplets from a valve ejection port, and controlling a supply amount of the liquid by moving a plunger rod with respect to the ejection port, the plunger rod being moved according to a pressure difference between the ejection port and a flow passage in a valve body, wherein the plunger rod is retracted by air pressure, and wherein bubbles are prevented from being mixed into the liquid through the ejection port.

2. A method of ejecting liquid droplets according to claim 1, wherein the liquid under regulated pressure is a liquid stored in a container.

3. A method of ejecting liquid droplets according to claim 1, wherein the liquid is continuously ejected at a high-speed tact.

4. A method of ejecting liquid droplets according to claim 1, wherein the liquid droplet is ejected through the ejection port with the plunger rod advanced by a resilient force of a spring.

5. A method of ejecting liquid droplets according to claim 4, wherein bubbles are prevented from mixed in the liquid through the ejection port upon retraction of the plunger rod by controlling a retraction speed of the plunger rod in accordance with an air flow rate.

6. An apparatus for ejecting liquid droplets in fixed amount, comprising:

a valve body having an ejection port;

a plunger rod for ejecting a liquid droplet upon advance and/or retraction thereof;

liquid supply means for supplying a liquid to said valve body;

valve-operating pressure control means for controlling valve-operating air to a desired pressure; and a selector valve being able to shift between a first position at which said valve-operating pressure control means is communicated with said valve body and a second position at which said valve body is communicated with the atmosphere, wherein the ejection port of said valve body being opened when said selector valve is in the first position and said plunger rod is retracted by the valve-operating air and being closed when said selector valve is in the second position and said plunger rod is advanced by plunger-rod driving means, and said valve-operating pressure control means and said valve body being communicated with each other via a flow control valve.

7. An apparatus for ejecting liquid droplets in fixed amount according to claim 6, wherein said plunger-rod driving means is in the form of a spring or air pressure.

8. An apparatus for ejecting liquid droplets in fixed amount according to claim 6, wherein said liquid supply means comprises a liquid reservoir container for supplying the liquid to said valve body, and liquid pressurizing means for pressurizing the liquid in said liquid reservoir container to a desired pressure.

9. An apparatus for ejecting liquid droplets in fixed amount according to claim 6, wherein said selector valve is a solenoid selector valve.

10. An apparatus for ejecting liquid droplets in fixed amount according to claim 6, wherein a wall surface of said valve body, with which said plunger rod is abutted, and a fore end surface of said plunger rod are formed as flat surfaces, and the ejection port is closed upon both the surfaces coming into a surface contact state.

11. An apparatus for ejecting liquid droplets in fixed amount according to claim 6, wherein a projection having a maximum outer diameter equal to an inner diameter of the ejection port is provided on a fore end surface of said plunger rod.

* * * * *